US007967186B2

(12) United States Patent
Brandinelli

(10) Patent No.: US 7,967,186 B2
(45) Date of Patent: Jun. 28, 2011

(54) PACKAGE WITH RECONFIGURABLE HANDLE

(75) Inventor: John W. Brandinelli, Parlin, NJ (US)

(73) Assignee: Mattel, Inc., El Segundo, CA (US)

( * ) Notice: Subject to any disclaimer, the term of this patent is extended or adjusted under 35 U.S.C. 154(b) by 180 days.

(21) Appl. No.: 12/250,084

(22) Filed: Oct. 13, 2008

(65) Prior Publication Data

US 2010/0089987 A1 Apr. 15, 2010

(51) Int. Cl.
*B65D 5/465* (2006.01)

(52) U.S. Cl. ..... 229/117.22; 229/117.19; 229/117.24

(58) Field of Classification Search ..... 229/117.5, 229/117.19, 117.22, 117.24
See application file for complete search history.

(56) References Cited

U.S. PATENT DOCUMENTS

| | | | | |
|---|---|---|---|---|
| 1,624,439 | A * | 4/1927 | Senat | 229/117.22 |
| 1,829,533 | A * | 10/1931 | Ondricek | 229/117.22 |
| 1,915,658 | A | 6/1933 | Gagen | |
| 2,365,887 | A | 12/1944 | Lind | |
| 2,434,630 | A * | 1/1948 | Van Rosen | 229/117.19 |
| 2,704,617 | A | 3/1955 | Stieve | |
| 2,795,367 | A | 6/1957 | Feldman et al. | |
| 2,795,368 | A | 6/1957 | Caster et al. | |
| 2,800,268 | A | 7/1957 | Mathews | |
| 2,807,407 | A | 9/1957 | Van Rosen | |
| 2,850,206 | A | 9/1958 | Pasjack | |
| 3,074,614 | A | 1/1963 | Moffat | |
| 3,111,241 | A | 11/1963 | Engel | |
| 3,140,813 | A | 7/1964 | Hall et al. | |
| 3,146,937 | A | 9/1964 | Vesak | |
| 3,176,326 | A * | 4/1965 | Zysman et al. | 5/703 |
| 3,239,110 | A | 3/1966 | Buter | |
| 3,258,152 | A | 6/1966 | Cameron | |
| 3,300,119 | A | 1/1967 | Chaussadas | |
| 3,511,434 | A | 5/1970 | Dews | |
| 3,531,042 | A | 9/1970 | Atkinson | |
| 3,684,153 | A * | 8/1972 | Detzel | 229/117.24 |
| 3,756,503 | A * | 9/1973 | Paige | 229/117.24 |
| 3,807,625 | A | 4/1974 | Akkerman | |
| 3,820,710 | A | 6/1974 | Burgess et al. | |
| 3,860,163 | A | 1/1975 | Dewhurst | |
| 3,940,055 | A | 2/1976 | Rowley | |
| 4,006,854 | A * | 2/1977 | Gibson et al. | 229/117.24 |

(Continued)

FOREIGN PATENT DOCUMENTS

EP 0305226 A 3/1989

(Continued)

OTHER PUBLICATIONS

International Search Report and Written Opinion received in PCT/US2009/059936 dated May 20, 2010, pp. 1-6.

*Primary Examiner* — Gary E Elkins
(74) *Attorney, Agent, or Firm* — Edell, Shapiro & Finnan LLC

(57) ABSTRACT

The present invention relates to a reconfigurable carrying device. The device includes a container and a handle. The handle is movably coupled to the container and reconfigurable between a collapsed or stored position and an extended or deployed position. In one position, the handle extends from the container to form a hand grip for carrying the container. In another position, the handle lies substantially flat against a wall or surface of the container from which the handle extends.

20 Claims, 14 Drawing Sheets

U.S. PATENT DOCUMENTS

| | | | | |
|---|---|---|---|---|
| 4,140,267 | A | | 2/1979 | Scott et al. |
| 4,157,763 | A | | 6/1979 | Betlejewski et al. |
| 4,195,765 | A | | 4/1980 | Roccaforte et al. |
| 4,308,995 | A | | 1/1982 | Hanes |
| 4,339,070 | A | * | 7/1982 | Davies ..... 229/117.24 |
| 4,498,619 | A | | 2/1985 | Roccaforte |
| 4,747,534 | A | | 5/1988 | Marie |
| 5,738,273 | A | | 4/1998 | Auclair |
| D396,805 | S | | 8/1998 | Broyles |
| 6,131,803 | A | | 10/2000 | Oliff et al. |
| 6,209,782 | B1 | | 4/2001 | Chou et al. |
| 6,971,572 | B2 | | 12/2005 | Ikeda |
| 7,042,712 | B2 | | 5/2006 | Ghosh et al. |
| 2002/0079245 | A1 | | 6/2002 | Auclair et al. |
| 2006/0266812 | A1 | | 11/2006 | Von Bokel |

FOREIGN PATENT DOCUMENTS

| | | | |
|---|---|---|---|
| GB | 2275913 | A | 9/1994 |
| JP | 2003312646 | A | 11/2003 |
| JP | 2005324808 | A | 11/2005 |

* cited by examiner

PACKAGE WITH RECONFIGURABLE HANDLE

FIELD OF THE INVENTION

The present invention relates to a carrying device or package including a reconfigurable handle having a stored configuration and a deployed configuration. In particular, the present invention relates to a carrying device that includes a handle that has a deployed configuration in which the handle extends from the package and is held by a user to support the weight of the carrying device, and a stored configuration in which the handle lies flat against the package.

BACKGROUND OF THE INVENTION

Businesses typically store, transport, and sell their products in various types of containers. Thin, lightweight packaging is popular because its thin walls minimize package sizes and lightweight material minimizes the combined weight of the package and product. At the point of purchase (e.g., in a retail store), individual products are usually sold in individual packaging. A handle is a convenient way of transporting such a package by enabling a purchaser to carry the package with one hand. Typically, handles extend from a package and provide a convenient grip for a person carrying the package. However, handles that extend from packages can be obstructive projections on the outside of such packages that increase the package outer profile, thereby requiring more space. Obstructions can give a package a shape that reduces the quantity of packages that can be stored if storage space is limited.

Thus, there is a need for a package that includes a handle that can be collapsed parallel with the package so that the handle is not obtrusive, but which is easily extendable from the package for conveniently carrying the package.

SUMMARY OF THE INVENTION

The present invention relates to a carrying device or package including a reconfigurable handle. The handle is reconfigurable between a deployed configuration in which the handle extends to be conveniently gripped by a person carrying the package and a stored configuration in which the handle is collapsed proximate to the package wall. In one embodiment, the package includes a container (e.g., a cardboard box). The container includes a body defining a receptacle. The container also includes a wall defining a portion of the receptacle. This wall has an outer side, an inner side, and first and second parallel slot openings or slots formed therein. In one embodiment, the receptacle wall is relatively thin and relatively flexible.

The handle is also formed from a relatively thin sheet material (e.g., cardboard, plastic, etc.) and includes a first end, a second end, and a center. The first end of the handle is bendable toward and away from the second end of the handle about the center. The first end includes a tab and the second end includes a tab. The handle is assembled to the container by slidably inserting the first end of the handle into the first slot in the container and the second end of the handle into the second slot in the container. The handle is interlocked with the container by outwardly extending the tabs past terminal ends of the corresponding slots. The tabs prevent the first and second ends of the handle from being removed from the slots. The center of the handle can then be extended on the outer side of the receptacle wall into a deployed configuration by pulling the center away from the outer side of the container wall until the tabs prevent further extension.

When the tabs are locked in their respective slots, the package can be carried by lifting the center of the handle. The tabs bear the weight of the package when the package is being carried in the deployed position. On the other hand, the handle can be reconfigured into a stored configuration by reinserting the first end and the second end into the container's slots until the handle is configured substantially parallel with the container wall. In the stored configuration, a substantial portion of the handle is positioned parallel and adjacent with the inner side of the receptacle wall.

BRIEF DESCRIPTION OF THE DRAWINGS

Like reference numerals have been used to identify like elements throughout this disclosure.

DETAILED DESCRIPTION OF THE INVENTION

The present invention relates to reconfigurable carrying device including a container having a repositionable handle. The container includes a body that defines a receptacle. The container also includes a receptacle wall defining a portion of the receptacle. The receptacle wall has an outer side that is visible and accessible from outside the container and an inner side that is opposite the outer side. The receptacle wall inner side can be enclosed on the interior of the receptacle if the receptacle is a completely enclosed receptacle. The receptacle wall includes two slots for receiving and securing the handle to the container. The handle is formed from a relatively thin, flat sheet material (e.g., paper, cardboard, plastic, etc.). The handle slidably interconnects with the receptacle wall to allow the handle to be reconfigured between a retracted position and a deployed position relative to the container.

The terms "reconfigurable," and "repositionable" may be used interchangeably herein. In addition, the terms "stored configuration" and "retracted configuration" may be used interchangeably and the terms "carrying configuration," and "deployed configuration" may be used interchangeably.

Figure 1:
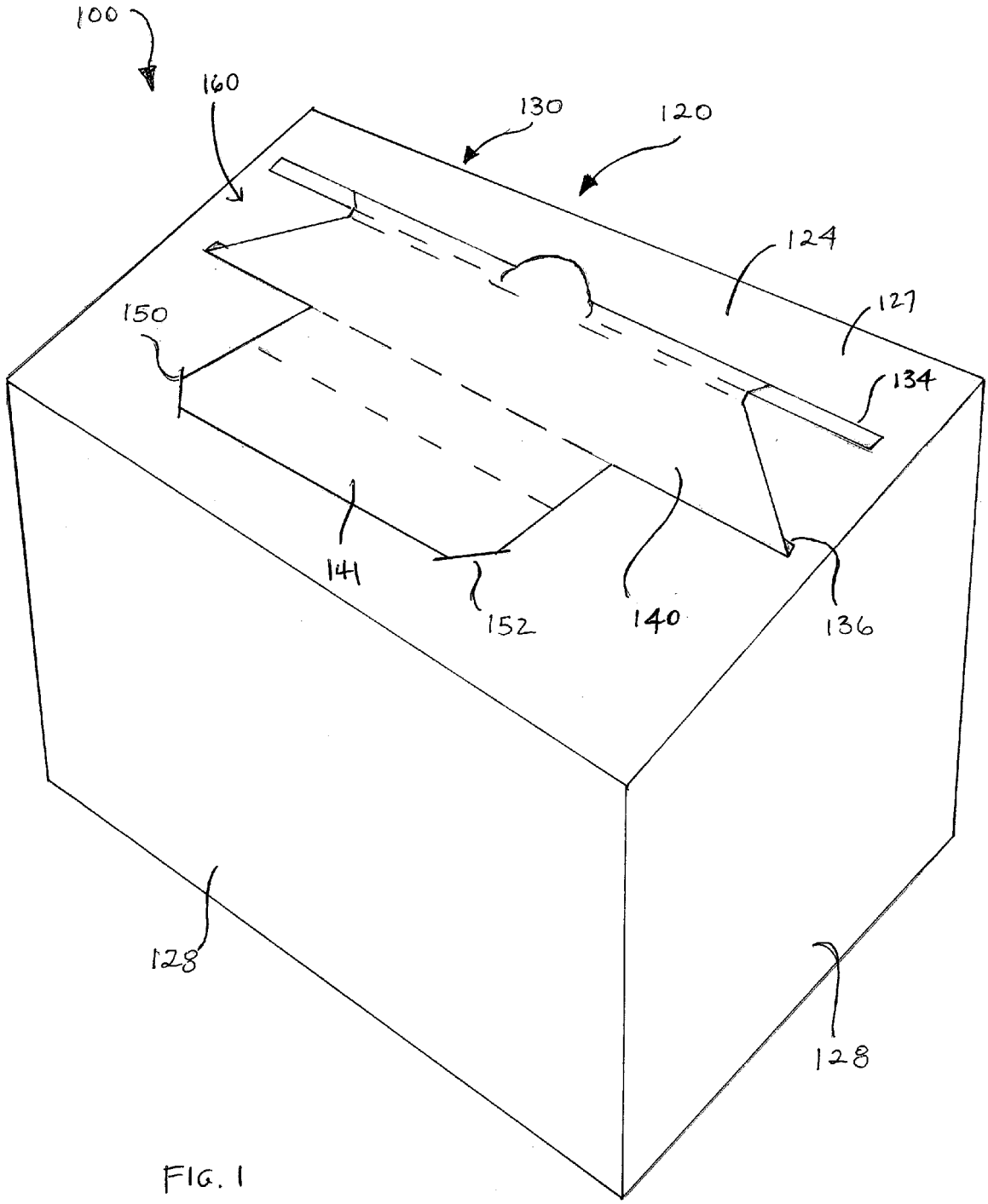
FIG. 1 illustrates a perspective view of an embodiment of the carrying device showing the handle in the stored position according to the present invention.

FIG. 1 illustrates a perspective view of an embodiment of a carrying device according to the present invention. In this embodiment, the carrying device 100 includes a container 120 (e.g., a cardboard box or structure) and a handle 140. The handle 140 is movably coupled to the container 120. The container 120 includes a body 130 defining a receptacle for carrying one or more objects or products (not shown). In this embodiment, the body 130 includes a receptacle wall 124 that defines a portion of the receptacle. In addition, the body 130 includes several sides 128 that with wall 124 collectively form or define a receptacle. In various embodiments, the sides 128 and wall 124 can have any shape or configuration and the container 120 may include any number of sides as desired.

The receptacle wall 124 includes an outer surface 127, an inner surface 125, and slots 134 and 136 formed therein. In one embodiment, the slots 134 and 136 are parallel to each other and have widths that are slightly larger than the thickness of handle 140. Handle 140 is shown in its collapsed or stored configuration 160 in FIG. 1. In this configuration, the handle 140 extends into the slots 134 and 136 and is disposed substantially or generally parallel to wall 124. In one embodiment, wall 124 also includes positioning slots or notches 150 and 152 that help secure a folding or foldable portion 141 of handle 140 in the collapsed configuration substantially parallel to wall 124. In an alternative embodiment, the wall 124 may not include any slots or notches 150 and 152.

As shown in FIG. 1, portions of handle 140 are inserted into first slot 134 and second slot 136 and are not visible. Other portions of handle 140 are accessible on the outer side of receptacle wall 124 and exposed to view. In the stored configuration, handle 140 lays substantially flat along receptacle wall 124, accordingly, does not form an obtrusion outwardly relative to receptacle wall 124 or a surface thereof. This unobtrusive configuration prevents handle 140 from being obstructive if container 120 must be stored in tight storage quarters (e.g., during the shipping process when a maximum number of similar containers must be shipped in a minimum storage space or on a store shelf).

Figure 2:
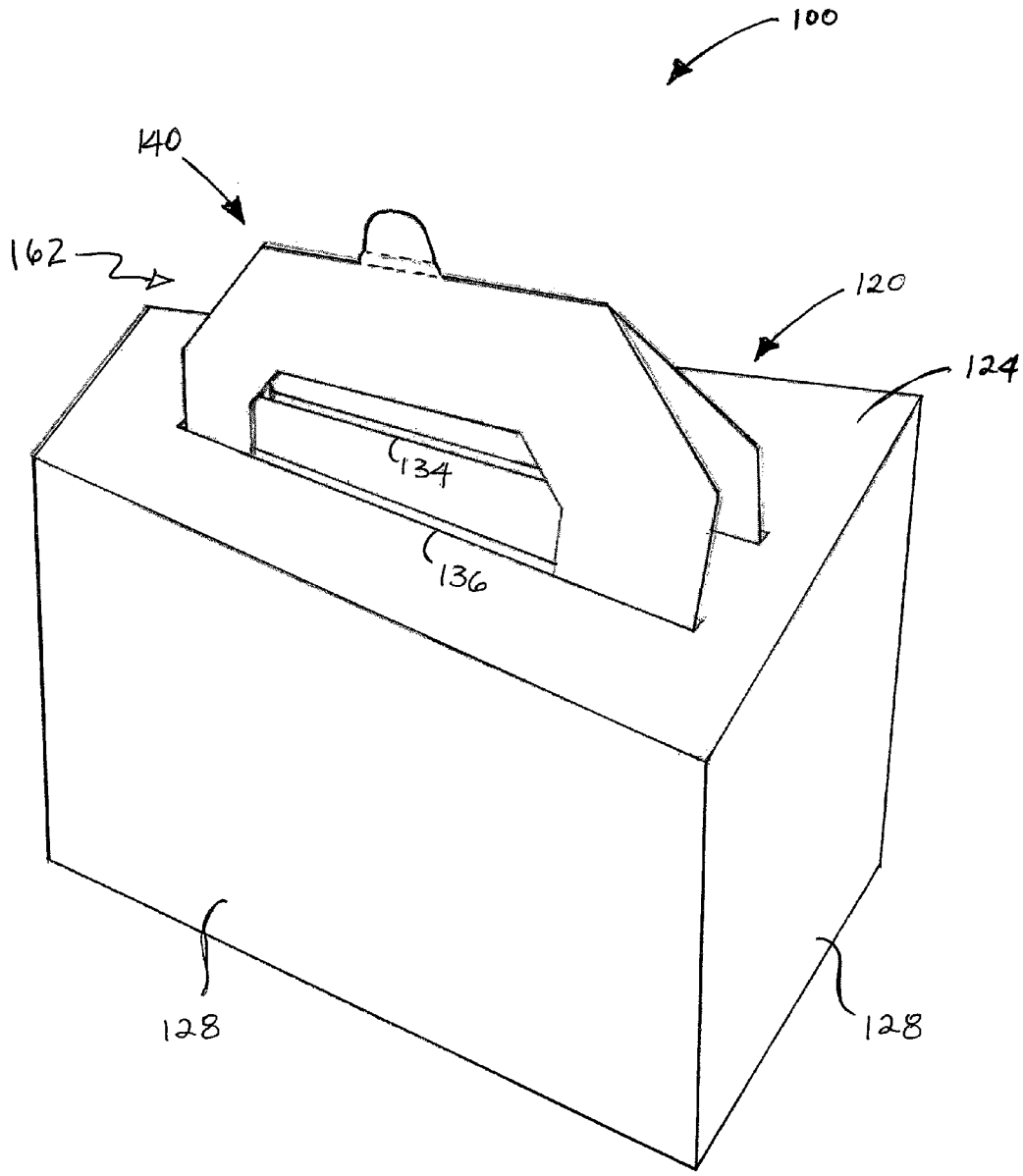
FIG. 2 illustrates a perspective view of the carrying device of FIG. 1 showing the handle in a deployed configuration.

FIG. 2 illustrates the carrying device 100 with the handle 140 in its deployed or carrying configuration 162. In this configuration 162, handle 140 extends away from the outer surface of receptacle wall 124 to allow a person transporting carrying device 100 to easily grip handle 140.

Figure 3:
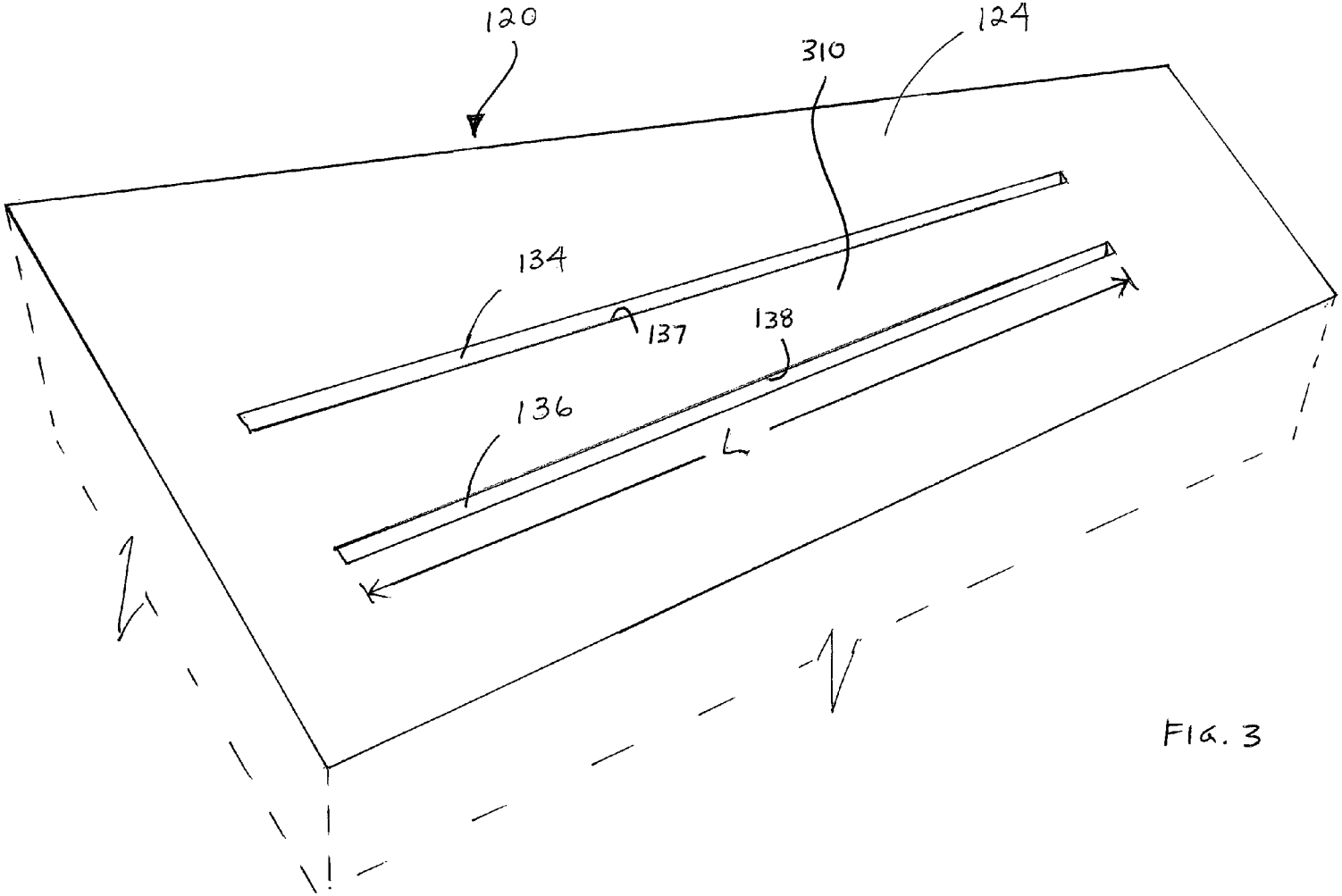
FIG. 3 illustrates a perspective view of a portion of the container of the carrying device of FIG. 1.

FIG. 3 illustrates a perspective view of a portion of the container 120 without the handle 140 coupled thereto. As shown, slots 134 and 136 are parallel slots, each of which having a length "L." Inner edges 137 and 138 of first and second slots 134 and 136, respectively, define a central strip 310 therebetween that secures handle 140 to container 120 in its collapsed configuration. In alternative embodiments, the length "L" of the slots 134 and 136 can vary as well as the distance between the slots 134 and 136.

Figure 4:
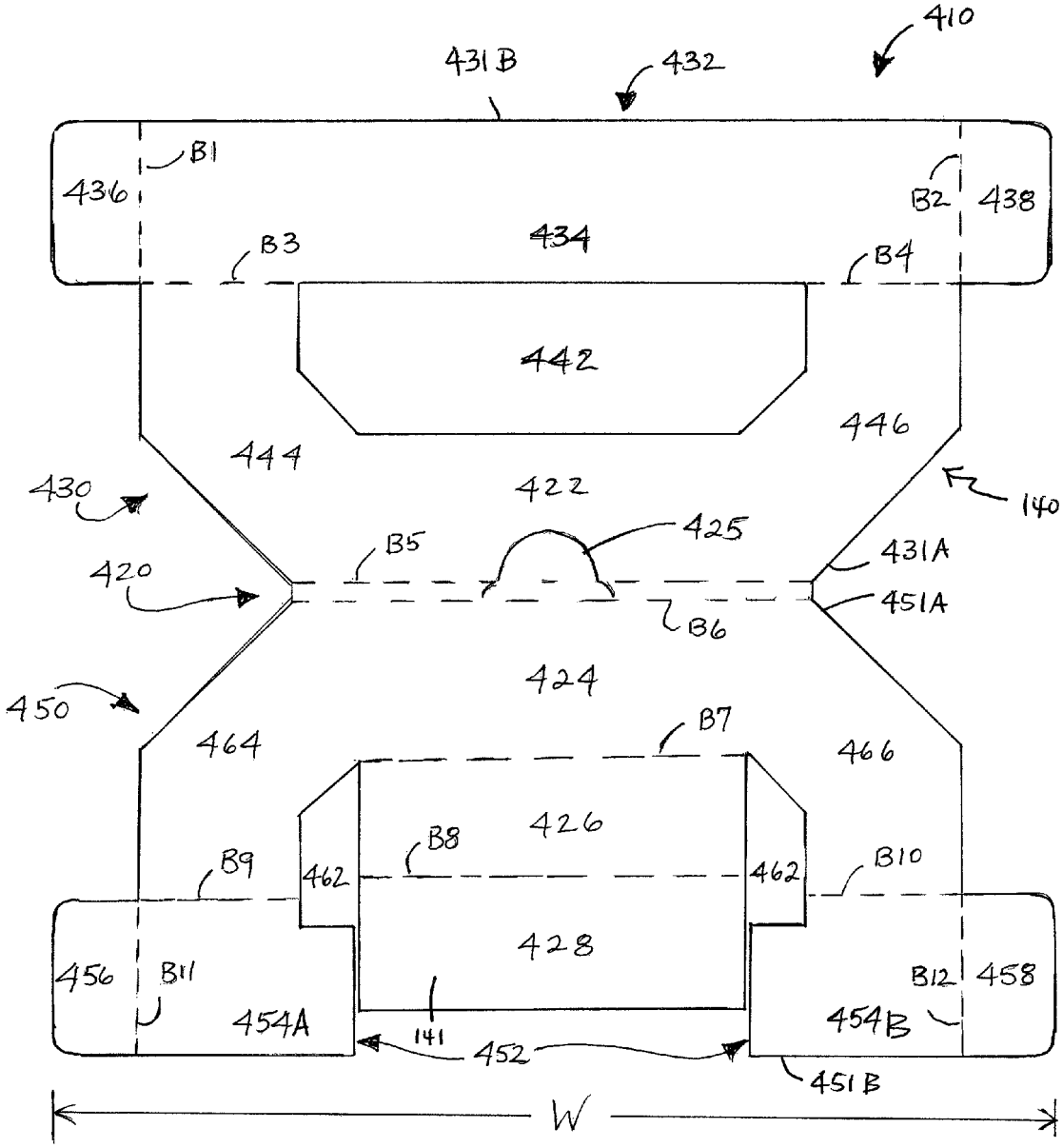
FIG. 4 illustrates a top view of the handle of the carrying device of FIG. 1.

FIG. 4 illustrates a top view of the handle 140, which has been laid substantially planar. In one embodiment, all of the components of the handle 140 are formed integrally as a single body. The handle 140 includes a body 410 with handle portions 430 and 450 that are separated by a center region 420. Center region 420 is a bendable, foldable portion that is located between handle portions 430 and 450. The center region 420, including grip portions 422 and 424, can be referred to collectively as a gripping region and can be disposed in different configurations.

Handle portion 430 extends from ends 431A to 431B and includes an engaging portion 432. Engaging portion 432 includes a central portion 434 with flap or tabs 436 and 438 on opposite sides of the central portion 434. Each of the tabs 436 and 438 can be referred to alternatively as a support extension or extending member. In the illustrated embodiment, engaging portion 432 has a width "W" that corresponds to the distance between the distal tips or ends of flaps 436 and 438. As shown in FIG. 4, engaging portion 432 is connected to the center portion 420 by arms 444 and 446.

Handle portion 450 extends from ends 451A to 451B and includes an engaging portion 452. Engaging portion 452 includes two spaced apart portions 454A and 454B with flaps or tabs 456 and 458, respectively, coupled thereto. Each of the tabs 456 and 458 can be referred to alternatively as a support extension or extending member. Engaging portion 452 also has a width "W" that is approximately the same dimension as the width "W" of engaging portion 432. Engaging portion 452 is connected to the center portion or region 420 by arms 464 and 466.

Adjacent to center region 420 are grip or gripping areas 422 and 424 and an actuator 425. Grip 422 is located on handle portion 430 between center region 420 and engaging portion 432 and between arms 444 and 446. Grip 424 is located on handle portion 450 between center region 420 and engaging portion 450 and between arms 464 and 466.

Actuator 425 is formed as tab that is cut from grip 422. Actuator 425 extends from center region 420 to facilitate reconfiguration of handle 140 from the stored configuration (see FIG. 1) to the deployed configuration (see FIG. 2). Use of actuator 425 to reconfigure handle 140 is described in greater detail below.

A finger space or opening 442 is formed in handle portion 430 by edges of central portion 434, arms 444 and 446, and grip 422. Similarly, a finger space or opening 462 is formed in handle portion 450 by edges of portions 454A and 454B, arms 464 and 466, and grip 424. As shown in FIG. 4, folding or foldable portion 141 includes grip or grip portions 426 and 428 that are foldable relative to grip portions 422 and 424 and can be used therewith. Grip 426 is adjacent to and extends from second grip 424. In addition, grip 428 is coupled to and extends from grip 426.

In this embodiment, handle 140 also includes several bend or fold lines or creases "B1" through "B12" that facilitate the bending or folding of different parts of the handle 140. The bending or folding of the handle 140 allows the handle 140 to be coupled to container 120 and reconfigured between its deployed and stored positions. The bend lines referred to below can be referred to alternatively as fold lines.

Referring to FIG. 4, the bend or fold lines "B1" through "B12" are indicated in dashed lines on body 410. Bend line "B1" is located between flap 436 and central portion 434. Similarly, bend line "B2" is located between flap 438 and central portion 434. Bend line "B3" is located between central portion 434 and arm 444 and bend line "B4" is located between central portion 434 and arm 446. Bend lines "B5" and "B6" are located between center region 420 and grips 422 and 424, respectively, and are used to move the handle portions 430 and 450 toward each other. The bend lines "B5" and "B6" create a bendable portion for the handle 140.

Bend lines "B7" and "B8" are used to change the shape of the grip portions 426 and 428. Bend line "B7" is located between grips 424 and grip 426 and bend line "B8" is located between grips 426 and 428. Bend line "B9" is located between portion 454A and arm 464 and bend line "B10" is located between central portion 454B and arm 466. Finally, bend line "B11" is between central portion 454A and flap or tab 456 and bend line "B12" is located between central portion 454B and flap or tab 458.

Figure 5:
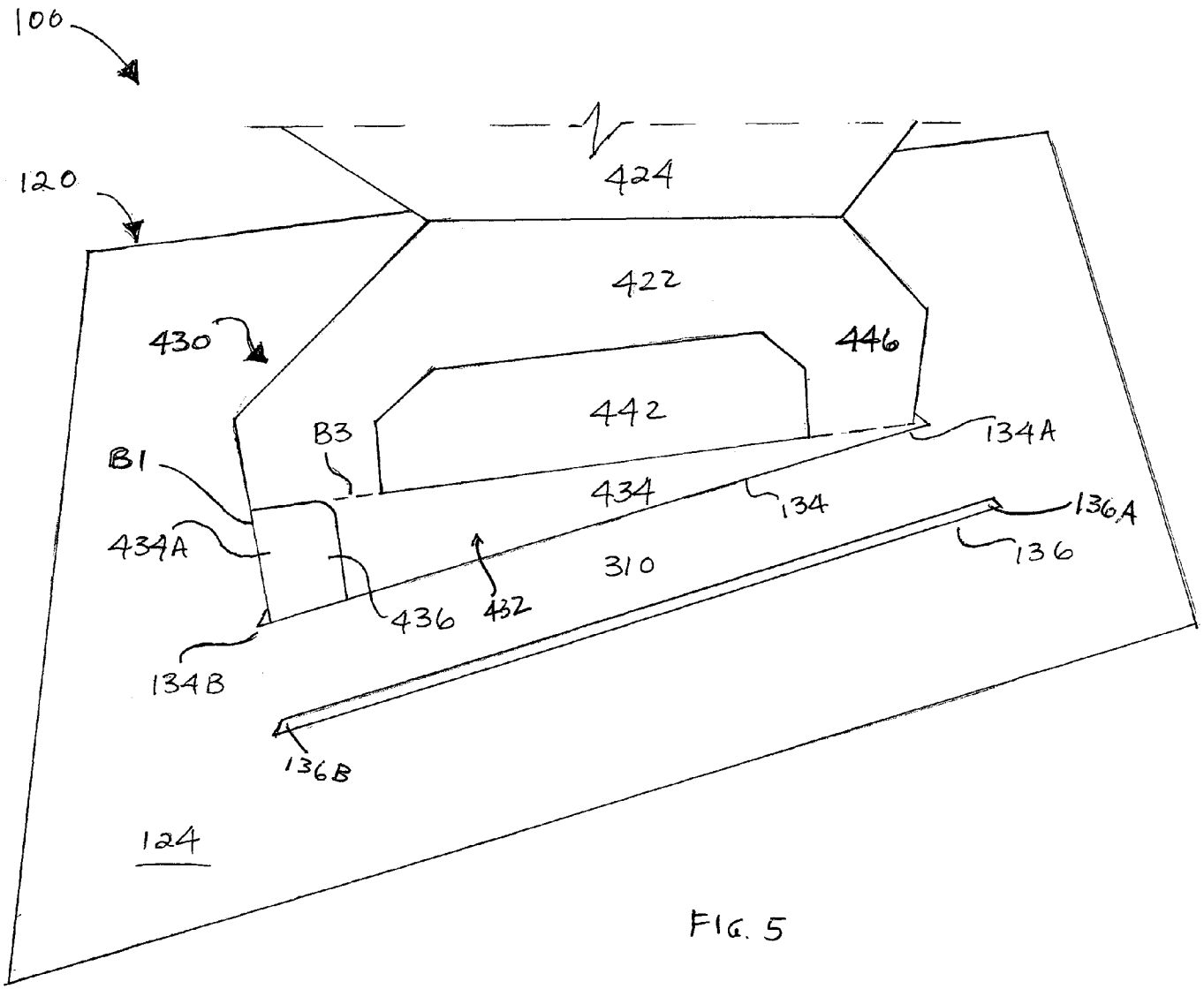
FIG. 5 illustrates a perspective view of a portion of the handle of the carrying device of FIG. 1 being inserted into a slot of the container.

Referring to FIG. 5, the use of some of the bend lines "B1" to "B12" is illustrated. In FIG. 5, a portion of the handle 140 is illustrated as being coupled to the container 120. As shown, slot 134 has opposite ends 134A and 134B. Similarly, slot 136 has opposite ends 136A and 136B. To insert handle portion 430 into slot 134 of wall 124, tab 438 (not shown in FIG. 5) is inserted into slot 134 beneath end 134A. Handle 140 is then slid toward end 134A of slot 134 until arm 446 contacts slot end 134A. Flap 436 is then bent along bend line "B1" so that an edge 434A of central portion 434 can pass through the slot 134 proximate to slot end 134B. After engaging portion 432 has passed completely through slot 134, flap 436 can be re-extended outwardly (to its position shown in FIG. 4) so that engaging portion 432 is extended to its full width "W." Since width "W" is greater than the length "L" of slot 134, the flaps or tabs 436 and 438 prevent engaging portion 432 from being removed from slot 134. Accordingly, handle portion 430 is coupled to the container 120. The other engaging portion 452 is similarly inserted and coupled to the container 120 via slot 136.

The sequence of steps described above for inserting handle portion 430 into slot 134 is merely illustrative and many other sequences of steps may be used or performed to couple the handle portion 430 to the container 120. For example, engaging portions 432 and 452 may be inserted simultaneously into slots 134 and 136, respectively. Handle 140 may be bent at center region 420 between handle portions 430 and 450 to direct simultaneously the engaging portions 432 and 452 into slots 134 and 136.

Alternatively, one of the engaging portions 432 and 452 may be inserted into its corresponding slots 134 and 136 and the handle 140 can be slid (in a first direction) into the container 120 through that respective slot until the other of the engaging portions 432 and 452 passes through the other of slots 134 and 136. The other of the engagement portions 432 or 452 can be slid into the other of slots 134 and 136 in the opposite direction.

Figure 6:
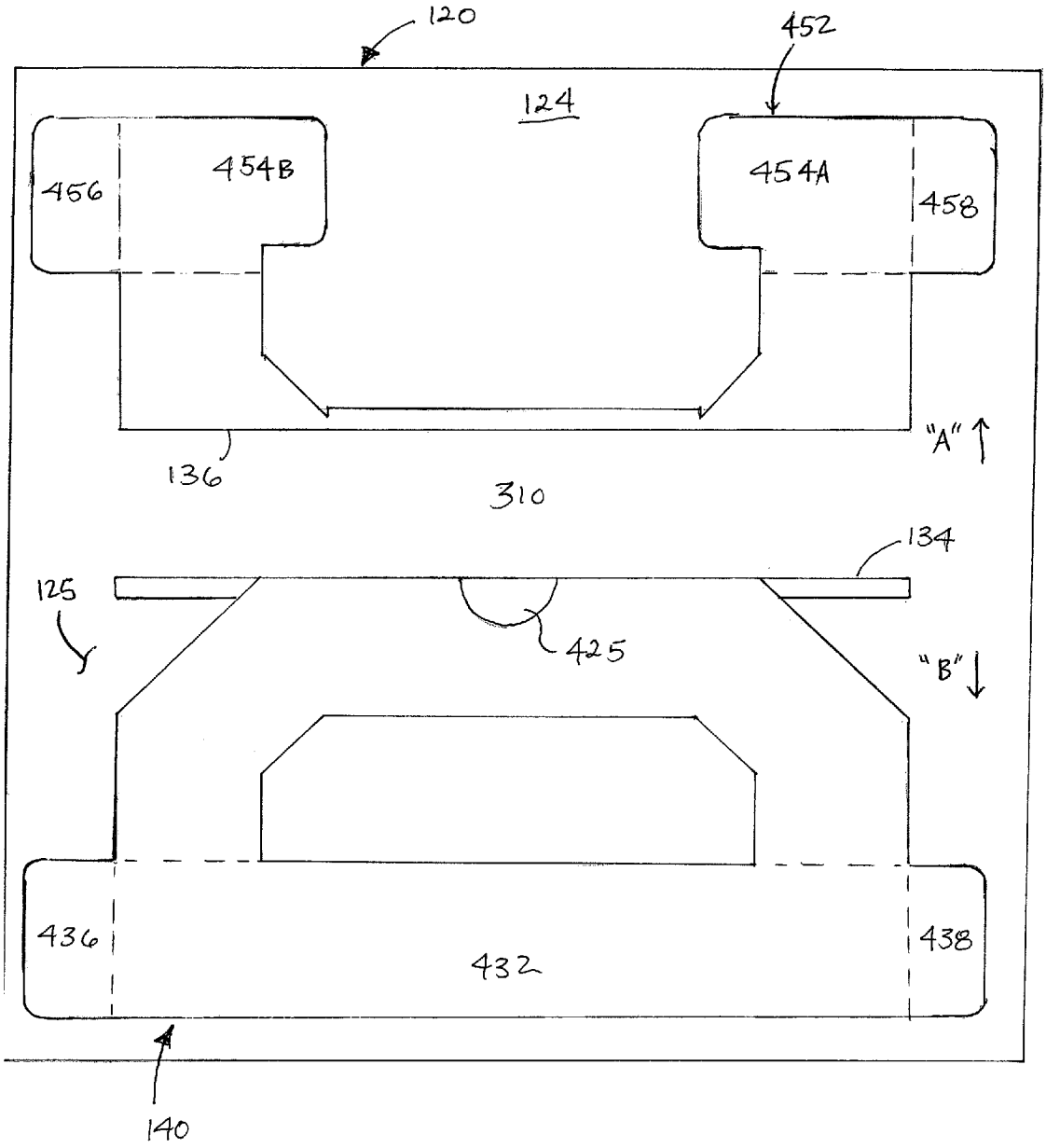
FIG. 6 illustrates an inner side receptacle wall view of the carrying device of FIG. 1 showing the handle in a stored configuration.

Referring to FIG. 6, a bottom view of the inner surface of receptacle wall 124 is illustrated. As shown, the receptacle wall 124 includes slots 134 and 136 that are separated by center strip or portion 310. The handle 140 is illustrated as being inserted into slots 134 and 136 and is disposed proximate to or in contact with the inner surface 125 of receptacle wall 124. In one embodiment, the width of central strip 310 is related to the relative stability with which container 120 is supported by handle 140. In other words, the wider that the slots 134 and 136 are away from each other, the more stable the handle portions 430 and 450 will be to support container 120.

Referring to FIG. 6, once the engaging portions 432 and 452 are inserted into the slots 134 and 136, the grip portions 422 and 424 are moved toward the receptacle wall 124 and slid along the directions of arrows "B" and "A," respectively, along the inner surface 125 of receptacle wall 124. As the engaging portions 432 and 452 are slid along those directions, the overall shape of the handle 140 flattens and approaches a substantially planar configuration, such as that illustrated in FIG. 6. In this configuration, when the handle 140 is in its collapsed configuration in which it is substantially planar, portions 454A and 454B with tabs 456 and 458 are proximate to the inner surface 125 and portion 432 with tabs 436 and 438 is proximate to the inner surface 125.

Figure 7:
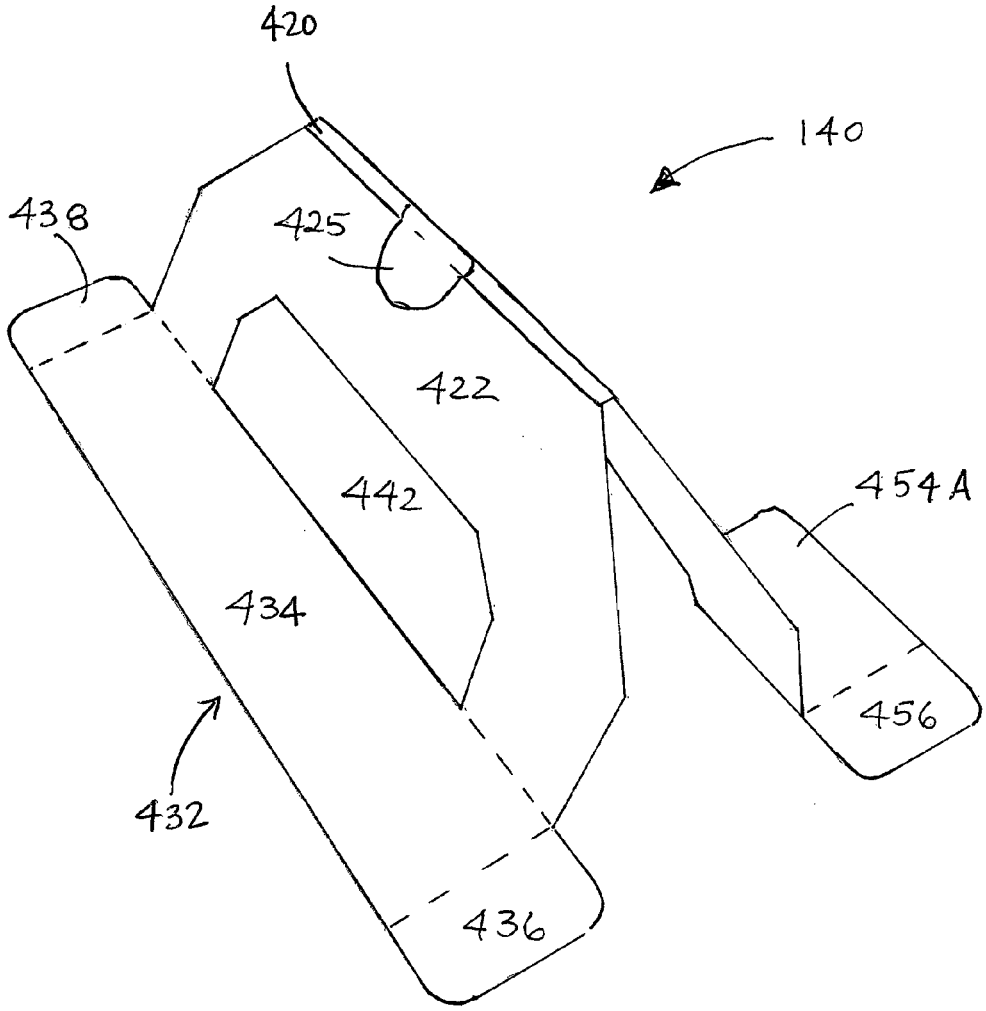
FIG. 7 illustrates a perspective view of the handle of the carrying device of FIG. 1 shown in a deployed configuration.
Figure 8:
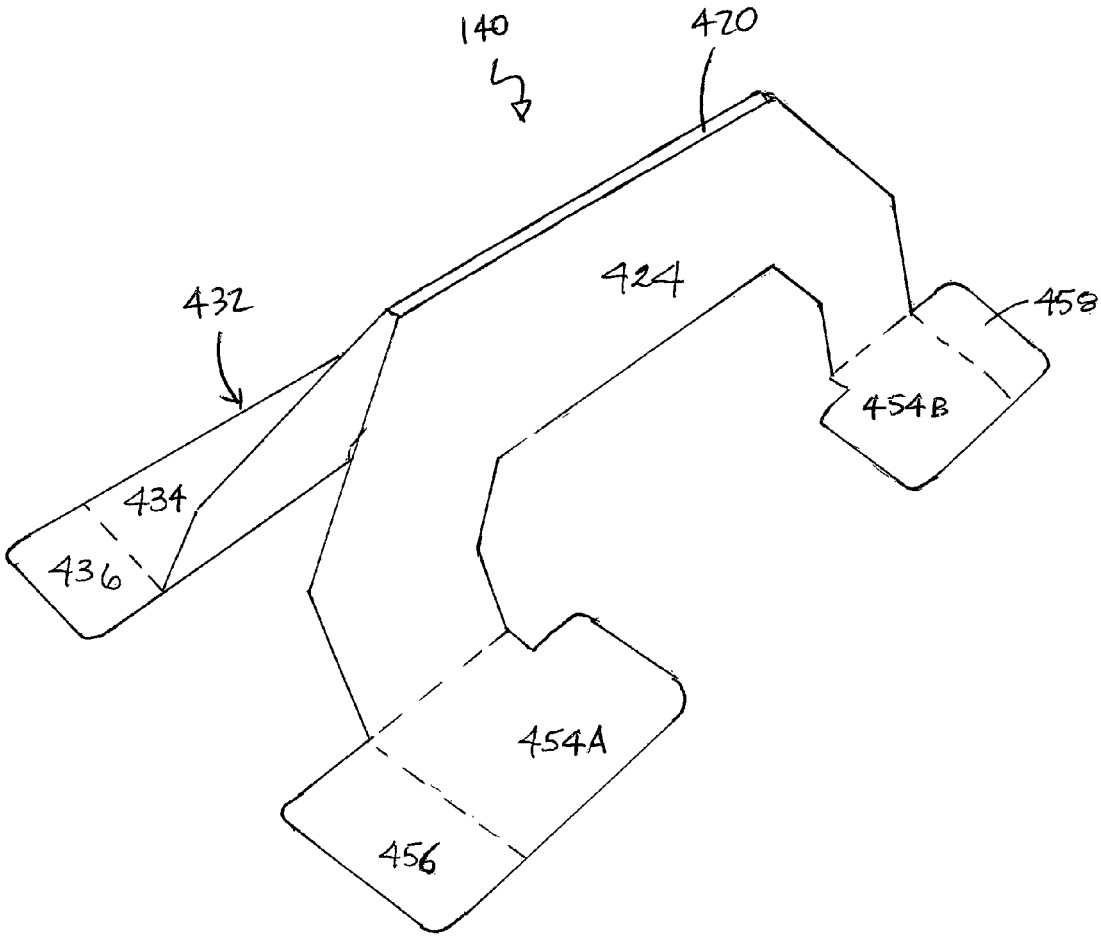
FIG. 8 illustrates an alternative perspective view of the handle of FIG. 7.
Figure 9:
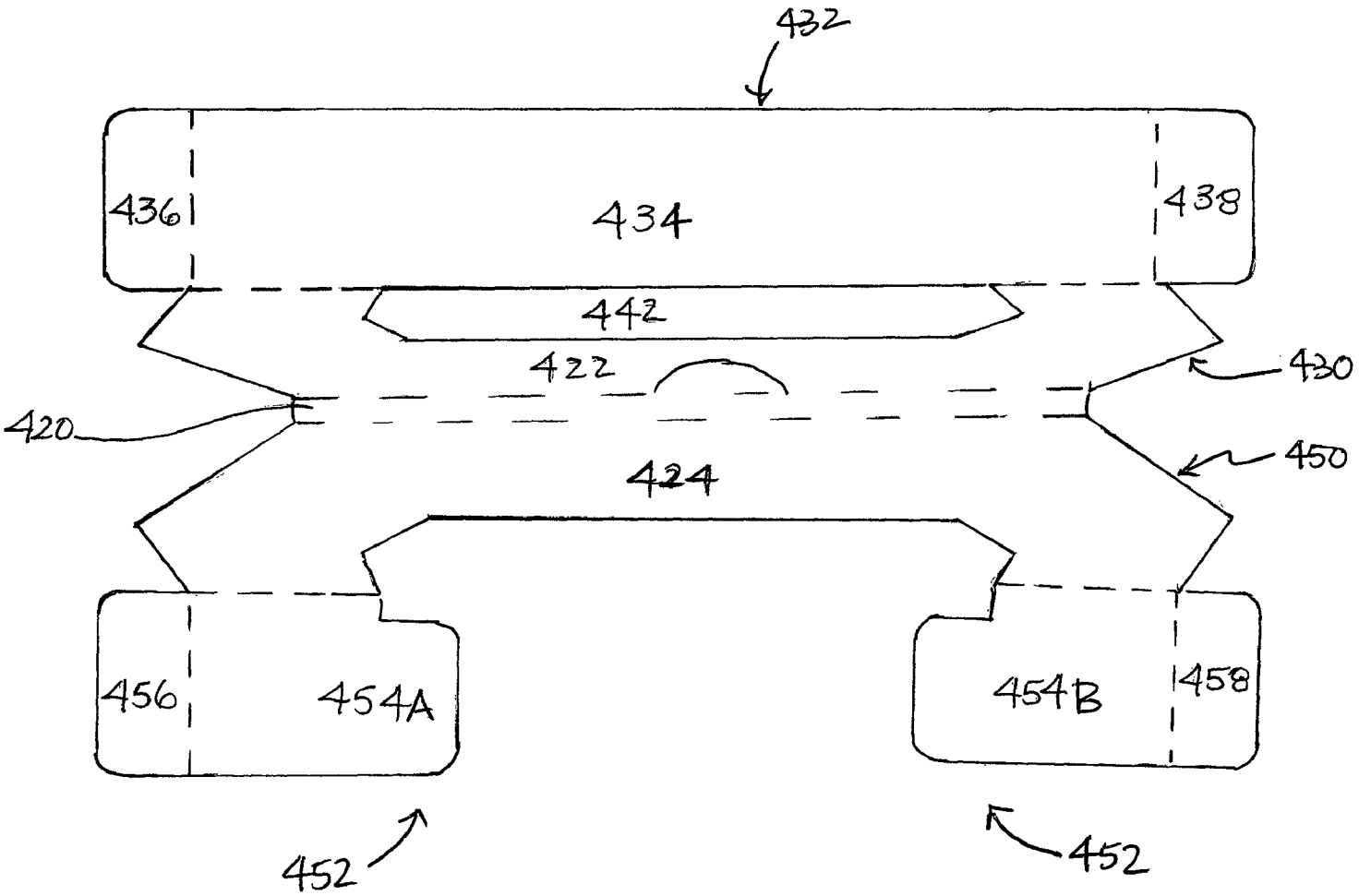
FIG. 9 illustrates a top view of the handle of FIG. 7.
Figure 10:
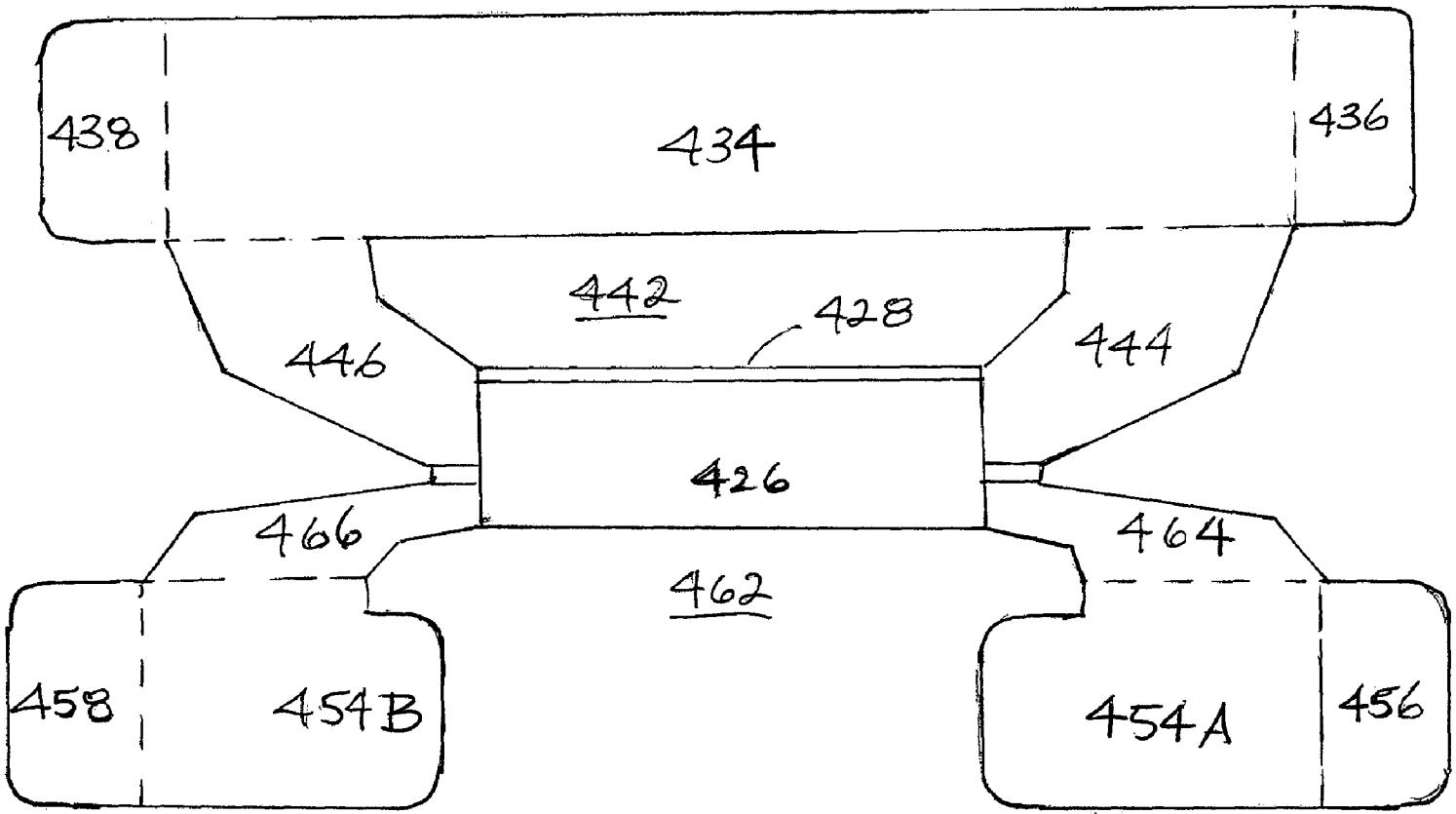
FIG. 10 illustrates a bottom view of the handle of FIG. 7.

Referring to FIGS. 7-10, different views of the handle 140 in its deployed configuration are illustrated. FIGS. 7 and 8 illustrate perspectives views of handle 140 and FIGS. 9 and 10 illustrate top and bottom views. Referring to FIGS. 7-9, a user can grasp the grip portions 422 and 424 of the handle 140 to lift the handle 140 and its associated container 120. Referring to FIG. 10, grip portions 426 and 428 have been folded so that grip portion 428 is proximate to and is positioned along grip portion 422. The grip portions 426 and 428 provide another surface for a user's hand or fingers in addition to the narrow edges of grip portions 422 and 424, as described below.

Figure 11:
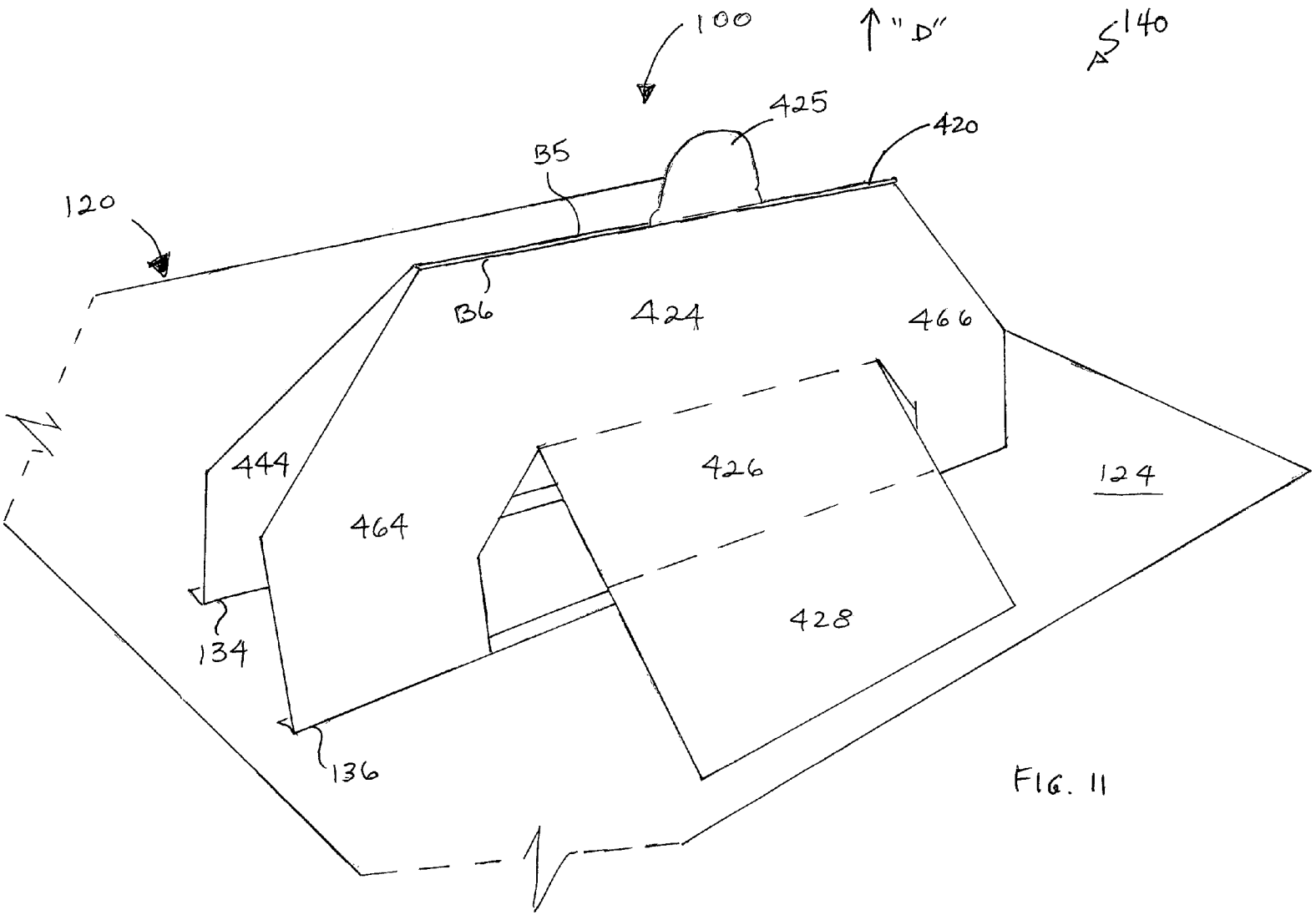
FIG. 11 illustrates a perspective view of a portion of the carrying device of FIG. 1 with the handle in a deployed position with an unfolded grip.
Figure 12:
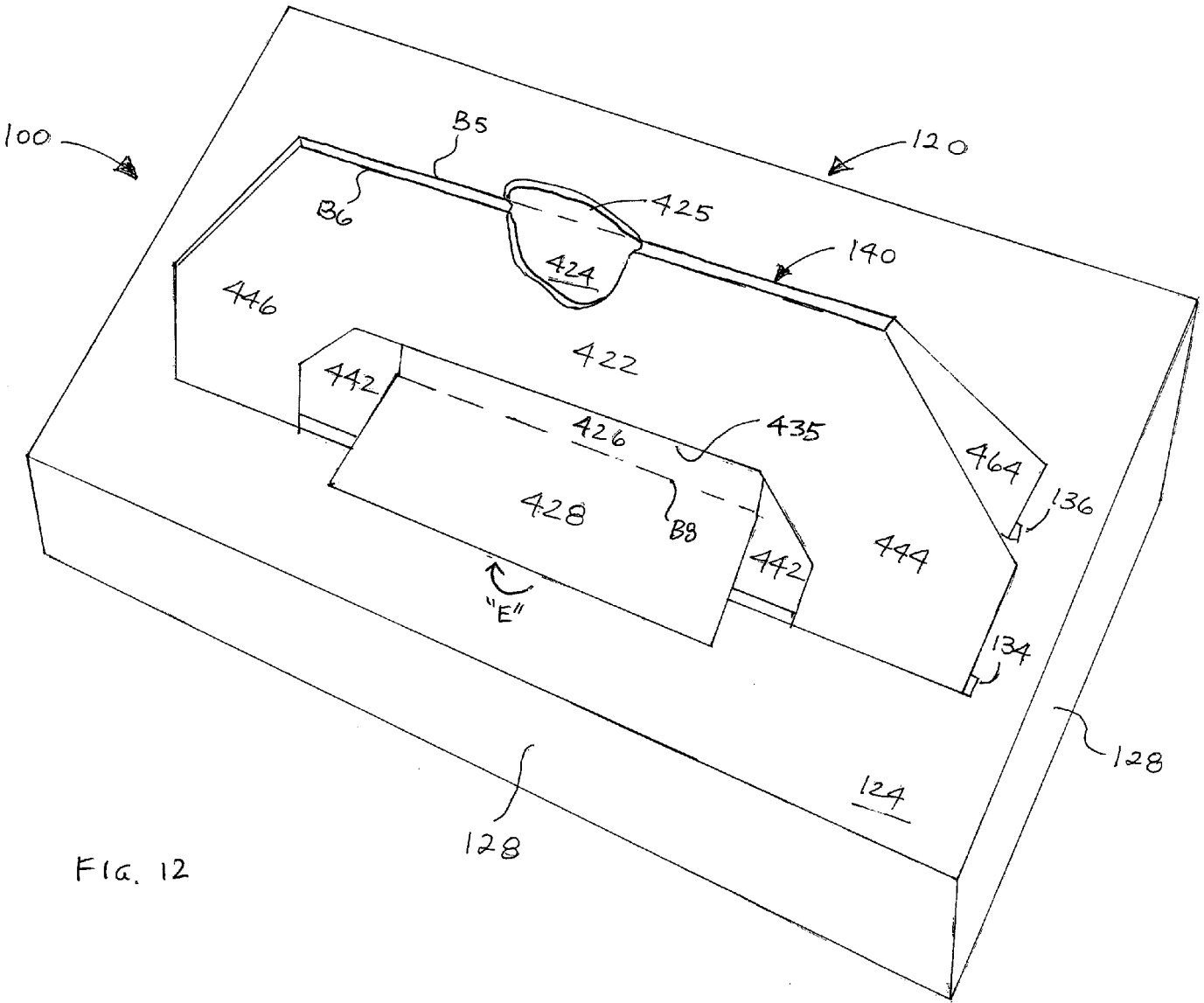
FIG. 12 illustrates a perspective view of the carrying device of FIG. 11 with the handle in a deployed configuration with a partially folded grip.

FIGS. 11 and 12 illustrate top perspective views of the carrying device 100 in a partially deployed configuration. To transform the handle 140 from the storage configuration 160 illustrated in FIG. 1 to the deployed configuration 162 illustrated in FIG. 2, actuator 425 is grasped and pulled away from the receptacle wall 124 and container 120 along the direction of arrow "D" in FIG. 11. During this movement, the handle 140 bends or folds about bend lines "B5" and "B6" and the handle portions 430 and 450 move toward each other. Movement of actuator 425 along the direction of arrow "D" raises the center region 420 into the partially deployed position shown in FIGS. 11 and 12 and pulls arms 444, 446, 464, and 466 outwardly through slots 134 and 136 in the same direction. In addition, grips 426 and 428 are lifted from their collapsed positions parallel with the receptacle wall 124 to raised positions spaced apart from the wall 124.

In the raised position, edge 435 is exposed in a location where it would contact a user's fingers when the user grasps the handle 140. Referring to FIG. 12, grips 426 and 428 are bent along bend lines "B7" and "B8." Grip 428 can be moved or folded along the direction of arrow "E" and either disposed on the outside of grip 422 or disposed along the inner surface of grip 422.

Figure 13:
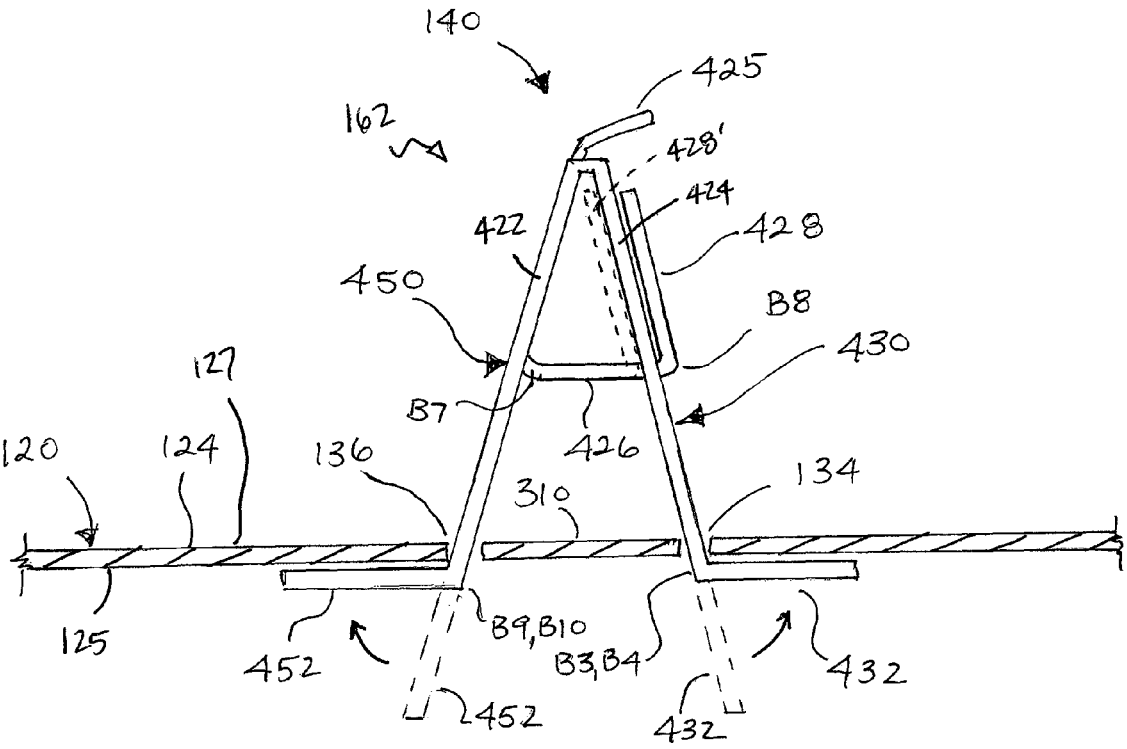
FIG. 13 illustrates a side view of the carrying device of FIG. 1 with the handle in a deployed configuration.

FIG. 13 illustrates a partial cross-sectional side view of the carrying device 100. The container 120 with wall 124 and slots 134 and 136 defining center portion 310 is illustrated. In addition, the handle 140 of the carrying device 100 is disposed in its deployed or carrying configuration 162. In this embodiment, the handle 140 in its carrying configuration 162 extends from and is substantially or generally perpendicular to the wall 124 and in particular, to the outer surface 127 of the wall 124. The handle portions 430 and 450 and the actuator 425 of the handle 140 are illustrated. As shown in FIG. 13, grip 426 has been bent along bend line "B7" and grip 428 has been bent along bend line "B8" to a final grip or gripping position. In these positions, grips 426 and 428 collectively fold around the lower edge 435 of grip 424 to protect a person's fingers from edge 435 and to create a gripping surface. The grip 428 can be placed on the outside of the grip 424 or alternatively, along the inside of the grip 424 (as shown by 428' and the dashed lines).

FIG. 13 also shows engaging portions 432 and 452 bent at corresponding bend lines "B3," "B4," "B9," and "B10." In the positions illustrated in FIG. 13, the engaging portions 432 and 452 are positioned parallel to and adjacent to the inner surface 125 of receptacle wall 124. This configuration of the engaging portions 432 and 452 may occur where an object, such as one or more products, within the receptacle engages or forces engaging portions 432 and 452 substantially parallel to receptacle wall 124. On the other hand, if engaging portions 432 and 452 are in the lowered positions shown in dashed lines and are not forced to be parallel, the engaging portions 432 and 452 remain relatively parallel with the corresponding remainders of the handle portions 430 and 450.

Figure 14:
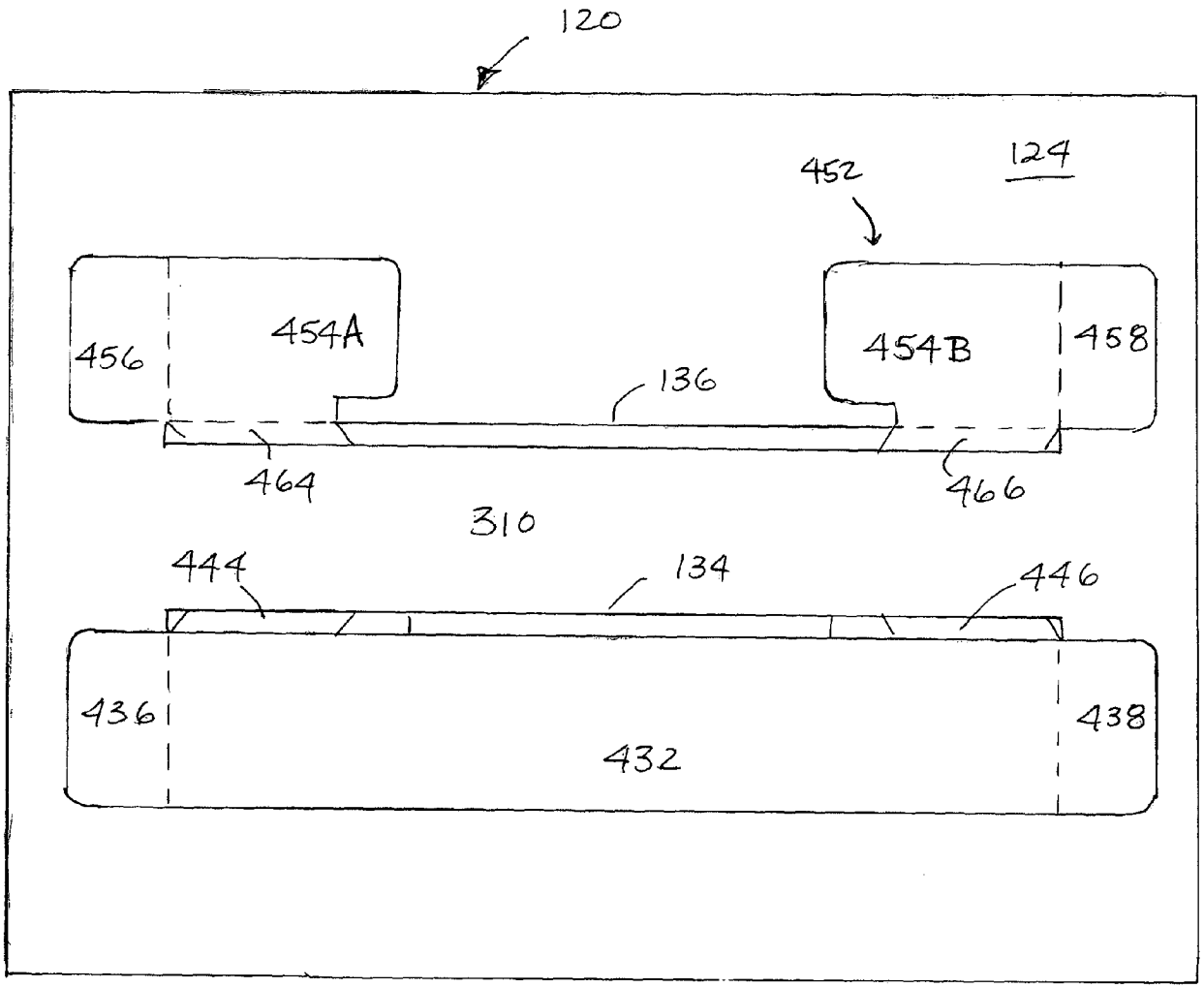
FIG. 14 illustrates an inner side receptacle wall view of the carrying device of FIG. 11 with the handle in a deployed configuration.

FIG. 14 illustrates a bottom view of the inner side of receptacle wall 124 of carrying device 100 with the handle 140 in its deployed configuration. As shown, engaging portions 432 and 452 extend outwardly from slots 134 and 136. The tabs 436, 438, 456, and 458 extend past their respective ends of slots 134 and 136, thereby coupling the handle 140 to the container 120. Accordingly, in the carrying configuration, the load of container 120 is transferred from the inner surface of receptacle wall 124 to the tabs 436, 438, 456, and 458, through the arms 444, 446, 464, and 466 and to the grips 422 and 424 and the center region 420.

Handle 140 can be transformed to the collapsed configuration 160 shown in FIG. 1 as easily as it is reconfigured to the deployed configuration 162 shown in FIG. 2. A user merely presses on center region 420 in a direction toward receptacle wall 124. The applied force causes the handle portions 430 and 450 to slide back into slots 134 and 136 until the center region 420 contacts the central strip 310. At this point, the handle 140 is disposed in the collapsed configuration 160 and is positioned substantially parallel with receptacle wall 124.

In different embodiments, the container can have any shape or configuration. The container can be made of any material and the receptacle need not be fully enclosed. In other embodiments, more than one handle according to the present invention may be coupled to the container 120. In addition, one or more handles can be used at one time in different carrying configurations.

The handle described herein is a collapsible, reconfigurable, dimensional handle. When the handle is disposed in its collapsed or substantially flat configuration, it allows for shipping of the container with the handle in that configuration.

While the invention has been described in detail and with reference to specific embodiments thereof, it will be apparent to one skilled in the art that various changes and modifications can be made therein without departing from the spirit and scope thereof. For example, it is to be understood that terms such as "top," "bottom," "front," "rear," "side," "length," "width," "upper," "lower," "inner," "outer," and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. A container with a reconfigurable handle, comprising:

a container, the container including a body defining a receptacle and including a wall defining a portion of the receptacle, the wall having an outer side and an inner side opposite the outer side, the wall including a first slot and a second slot extending therethrough; and a handle, the handle including a first handle portion and a second handle portion, each of the first and second handle portions including an open section that forms a finger space configured to facilitate gripping by a user during use of the handle, the open section of the first handle portion being separate from and non-contiguous in relation to the open section of the second handle portion, the first handle portion and the second handle portion being coupled together and moveable relative to each other, the first handle portion being slidably mounted in the first slot, the second handle portion being slidably mounted in the second slot, the handle being selectively disposable in a stored configuration in which the first handle portion and the second handle portion are disposed substantially parallel to and proximate to the inner side of the wall of the container such that the open sections of the first and second handle portions are disposed below the wall and within the container and in a deployed configuration in which the first handle portion and the second handle portion extend outwardly from and are disposed transverse to the outer side of the wall such that the open sections of the first and second handle portions are exposed and disposed above the wall.

2. The container of claim 1, wherein the handle includes a center region between the first handle portion and the second handle portion, the center region having a first configuration when the handle is in its stored configuration and a second configuration when the handle is in its deployed configuration.

3. The container of claim 2, wherein the center region includes an actuator, the actuator being configured to be pulled by a user to move the handle from its stored configuration to its deployed configuration.

4. The container of claim 1, wherein each of the first slot and the second slot in the wall has a length, the first handle portion includes a first engaging portion having a width, the width of the first engaging portion being greater than the length of the first slot, the second handle portion including a second engaging portion having a width, the width of the second engaging portion being greater than the length of the second slot, the first engaging portion and the second engaging portion being disposed on the inside of the wall and the first engaging portion and the second engaging portion limiting the movement of the handle outwardly to its deployed configuration.

5. The container of claim 4, wherein the first engaging portion has a first tab proximate to a first end of the first engaging portion and a second tab proximate to a second end of the first engaging portion, the second tab extending away from the first tab, the distance between ends of the first tab and the second tab being greater than the length of the first slot, and each of the first tab and the second tab being foldable relative to a remainder of the first engaging portion.

6. The container of claim 1, wherein the handle includes a grip portion, the grip portion being foldable to provide a protective hand grip by covering an exposed handle edge defined at the open section of one of the first and second handle portions.

7. The container of claim 6, wherein the container includes at least one notch for retaining the grip portion in a stored configuration.

8. The container of claim 1, wherein the handle is an integrally formed body.

9. The container of claim 1, wherein the handle includes at least one bend line and movement of the handle between the stored configuration and the deployed configuration causes the handle to fold along the at least one bend line.

10. A carrying device, comprising:

a container, the container including a side with a first slot and a second slot; and a handle, the handle including a first handle portion and a second handle portion, the first handle portion being slidably disposed in the first slot and the second handle portion being slidably disposed in the second slot, the handle including an intermediate portion between the first handle portion and the second handle portion that is configured to be used as a grip, the grip being defined at a section disposed between open sections in each of the first and second handle portions, each of the open sections forming a finger space configured to facilitate gripping by a user during use of the handle, the open section of the first handle portion being separate from and non-contiguous in relation to the open section of the second handle portion, the handle being disposable in a retracted configuration in which the first handle portion and the second handle portion are disposed generally parallel to the side such that the open sections of the first and second handle portions are disposed below the side and within the container and in a carrying configuration in which the intermediate portion is bent and the first handle portion and the second handle portion are disposed transverse to the side such that the open sections of the first and second handle portions are disposed above the side, the handle being moved from the retracted configuration to the carrying configuration by sliding the first handle portion and second handle portion in the first slot and the second slot of the container, respectively.

11. The carrying device of claim 10, wherein each of the first slot and the second slot has a first end and a second end, and each of the first handle portion and the second handle portion includes a support extension extending beyond the ends of the first slot and the second slot so that when the handle is in its carrying configuration, the support extensions prevent removal of the first handle portion and the second handle portion from the first slot and the second slot.

12. The carrying device of claim 11, wherein the intermediate portion includes a foldable portion, the foldable portion being disposable in a stored position in which it is substantially parallel to the handle and in a deployed position in which it engages the intermediate portion and forms a gripping area.

13. The carrying device of claim 12, wherein the foldable portion includes a first grip portion and a second grip portion, the first grip portion being foldable relative to the second grip portion, the second grip portion being disposable proximate to the intermediate portion.

14. The carrying device of claim 13, wherein the handle includes an actuator, the actuator being configured to be grasped by a user to move the handle from its retracted configuration to its deployed configuration.

15. A method of using a carrying device, the carrying device including a package with a wall defining a first slot and a second slot, the carrying device including a handle having a gripping region, a first handle portion, and a second handle portion, each of the first handle portion and the second handle portion including an extending member, and the gripping region being defined at a section disposed between open sections in the first and second handle portions, each of the open sections forming a finger space configured to facilitate gripping by a user during use of the handle, the open section of the first handle portion being separate from and non-contiguous in relation to the open section of the second handle portion, the method comprising the steps of:

mounting the first handle portion in the first slot;

mounting the second handle portion in the second slot; and moving the gripping region toward the wall so that the first handle portion including the open section of the first handle portion slides in the first slot and the second handle portion including the open section of the second handle portion slides in the second slot, and the handle moves so that it is disposed substantially parallel to the wall of the package with parts of each of the first handle portion and the second handle portion proximate to and substantially parallel to an inner side of the wall.

16. The method of claim 15, further comprising:

moving the gripping region away from the wall until the extending members engage the inner surface of the wall and the open sections of the first and second handle portions are withdrawn from the first and second slots and exposed.

17. The method of claim 16, wherein the moving the gripping region includes bending the gripping region so that the first handle portion and the second handle portion move toward each other as the gripping region moves away from the wall.

18. The method of claim 17, wherein the gripping region includes an actuator, and the moving the gripping region away includes pulling on the actuator away from the wall.

19. The method of claim 15, wherein the mounting the first handle portion in the first slot and the mounting the second handle portion in the second slot occur substantially simultaneously.

20. The method of claim 19, wherein the moving the gripping region toward the wall includes substantially flattening the handle.

* * * * *